US005373278A

United States Patent [19]

Saulgeot et al.

[11] Patent Number: 5,373,278

[45] Date of Patent: Dec. 13, 1994

[54] FLAT FUSE FOR HIGH RATED CURRENTS

[75] Inventors: Jean-Michel Saulgeot, Lucinges; Gilles Pittion, Bons-en Chablais, both of France

[73] Assignee: DAV, France

[21] Appl. No.: 90,019

[22] PCT Filed: Jan. 13, 1992

[86] PCT No.: PCT/FR92/00021

§ 371 Date: Aug. 31, 1993

§ 102(e) Date: Aug. 31, 1993

[87] PCT Pub. No.: WO92/13356

PCT Pub. Date: Jun. 8, 1992

[30] Foreign Application Priority Data

Jan. 16, 1991 [FR] France ..... 91 00418
Dec. 20, 1991 [FR] France ..... 91 15881

[51] Int. Cl.[5] ..... H01H 85/14

[52] U.S. Cl. ..... 337/255; 337/256; 337/261

[58] Field of Search ..... 337/255, 256, 257, 258, 337/259, 260, 261, 262, 263, 264, 163, 164

[56] References Cited

U.S. PATENT DOCUMENTS 4,635,023 1/1987 Oh .
4,831,353 5/1989 Gaia et al. ..... 337/255
4,958,426 9/1990 Endo et al. .
5,229,739 7/1993 Oh et al. ..... 337/290

FOREIGN PATENT DOCUMENTS 2500364 7/1975 Germany .
2090081 6/1982 United Kingdom .
2178913 2/1987 United Kingdom .
89/03117 4/1989 WIPO .

*Primary Examiner*—Lincoln Donovan
*Attorney, Agent, or Firm*—Ostrolenk, Faber, Gerb & Soffen

[57] ABSTRACT

Blade type plug-in fuse for high nominal currents.

It is of the type comprising a case (1) in which is partially housed a conductive unit (5, 6, 9, 10) provided with two flat connection terminal blades (5, 6) whose free ends (7) are situated outside the case, said connection terminal blades being connected inside the case by a flat fuse link part (8) on at least one side and substantially in the center of which is deposited a drop of metal (13) of predetermined area of contact, and it is characterized in that the fuse link part comprises a central gauging zone (9) of width ($l_1$) smaller than the width ($l_2$) of the adjacent lateral zones (21) connecting with the connection terminal blades, the area of contact (31) of said drop (13) being at least greater than half the area of the gauging zone (9).

18 Claims, 4 Drawing Sheets

FLAT FUSE FOR HIGH RATED CURRENTS

BACKGROUND OF THE INVENTION

1. Field of the Invention

This invention relates to a blade type plug-in fuse for nominal currents in excess of or equal to 20 amperes, and more particularly to automobile blade type plug-in fuses.

2. Description of the Related Art

Blade type fuses are increasingly used in automobile equipment, for the purposes of space requirements, protective qualities and ease of plugging in. Such fuses generally comprise an insulating case or body in which is partially mounted a conductive unit constituted by two connection terminal blades joined together by a fuse link element or gauging part.

A fuse of this type is described in U.S. patent application Ser. No. 3,909,767.

However, the structure and type of materials used to manufacture these blade type plug-in fuses were chosen for a nominal current circulating in the fusible link element and connection terminal blades of less than 30 amperes.

For higher nominal currents of up to 100 amperes and more, the fuse link element can sag and come into contact with one of the inner sides of the insulating body or case. As the material used for the case is a plastic material, it ensues that the contact with the fuse link element is apt to melt the plastic material and to engender the complete deterioration of the case.

The sagging phenomenon generally occurs at the center of the gauging part since it is at this spot that the hottest point is situated when the temperature curve is plotted. The solutions that have been advocated to solve the sagging issue have either been to reduce the cross section of the gauging part in the region of the hot spot, or to deposit a drop of metal at the center of said gauging part when it is constituted by a metal wire, or to provide an opening in the region of the hot spot and deposit a drop of metal on both sides of the opening. All these solutions are disclosed in British patent application No. 2,090,081 and U.S. patent application Ser. No. 4,435,023. In the solution involving drops of tin deposited on both sides of the central opening, the structural parameters must be selected as a function of the nominal current of the flat fuse. In this way, the length, width and thickness of the fuse element are not the same for a 40-ampere flat fuse and for a 60-ampere flat fuse, which constitutes a serious drawback for large-scale production. Moreover, it may be necessary to change the location of the drops of tin and therefore of their openings where they are deposited as a function of the length of the fuse link element.

In German patent application No. 2,500,364, a flat fuse is described comprising a fuse link element produced in a single piece with the connection terminal blades, but which is partially recessed in the central part so as to produce a thinner zone of constant thickness and cross section, only the thinner zone constituting the gauging zone.

In the PCT/US88/02924 application, the gauging part of the fuse link element comprises cut-outs intended to provide cooling zones susceptible of generating a retarding effect on the sagging of said gauging part.

SUMMARY OF THE INVENTION

French patent No. E-53927 describes a fuse whose central part has a width smaller than the rest of the fuse link element which is nevertheless big to obtain the required retarding effect.

The aim of this invention is to remedy the above-mentioned drawbacks and to provide a blade type plug-in fuse comprising a flat fuse link part of short length, in which the temperature communicated to the connection terminal blades is reduced before breakdown.

The object of this invention is a blade type plug-in fuse, of the type comprising a case in which is partially housed a conductive unit provided with two flat connection terminal blades whose free ends are situated outside the case, said connection terminal blades being connected inside the case by a flat fuse link part in three parts and whose central gauging zone has a length shorter than or equal to two-thirds of the fuse link part, a drop of metal being deposited on one side of the gauging zone and having an area of contact of said drop which is substantially equal to the area of the gauging zone.

One advantage of this invention is to enable the drop of metal to spread over almost the entire gauging zone without risk of contact with the connection terminal blades.

A further advantage of this invention resides in the fact that the gauging part has a reduced length and a possibility of constant thickness whatever the nominal current of gauge of the flat fuse.

According to another embodiment of the invention, the fuse link part comprises two flat gauging zones mounted parallel to one another, of which at least one of said zones is provided, approximately at the center, with at least one drop of metal.

DETAILED DESCRIPTION OF THE PREFERRED EMBODIMENTS

Figure 1:
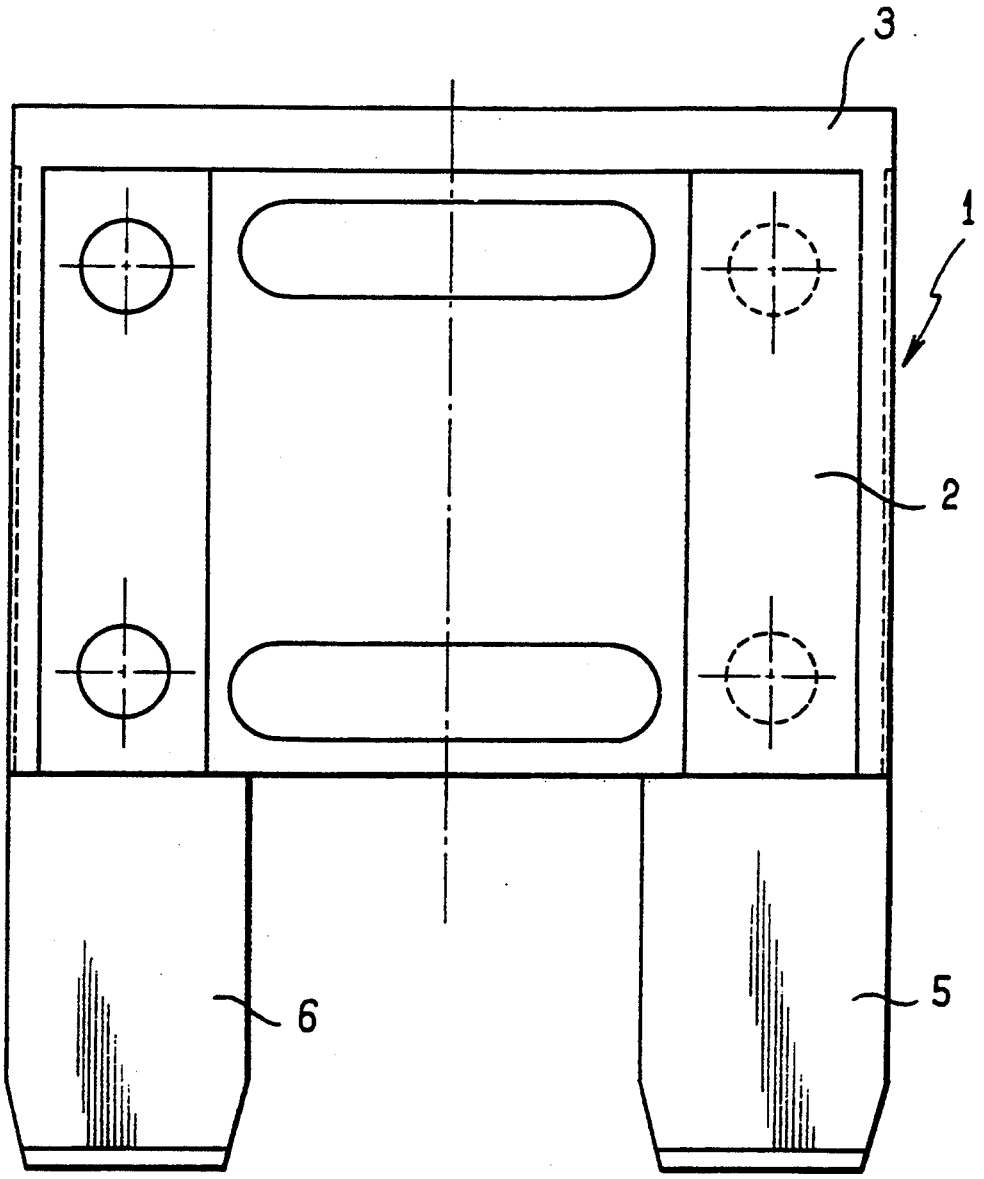
FIG. 1 is a two-dimensional view of the blade type plug-in fuse comprising a protective case in which is disposed the conductive unit represented in FIG. 2.

The case 1 represented in FIG. 1 can be of the single-piece type or in two parts, the front part or cover 2 being mounted by crimping or other means on the rear part or supporting body 3, e.g. as described in French patent application No. 87-04382.

Figure 2:
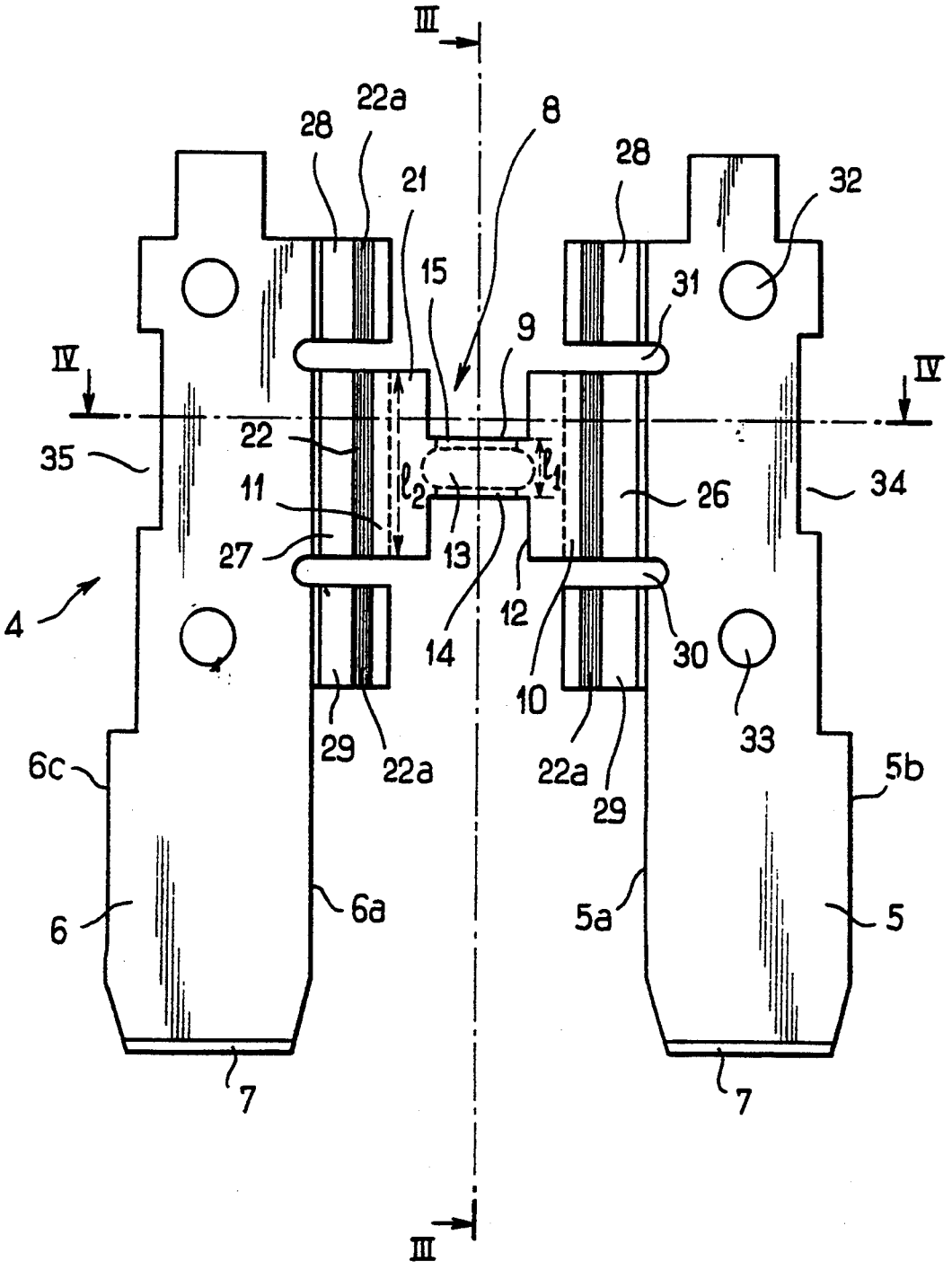
FIG. 2 is a two-dimensional view of the conductive unit according to an embodiment of the invention.

A conductive unit 4 according to the invention, represented in FIG. 2, is mounted in the case 1.

The conductive unit comprises two connection terminal blades 5 and 6 whose ends 7 are bevelled to enable easy insertion into the corresponding housings provided in various receiving units such as interconnection boxes. A fuse link part 8 is mounted between the connection terminal blades 5 and 6 and is connected to the inner sides 5a and 6a of the latter.

Figure 4:
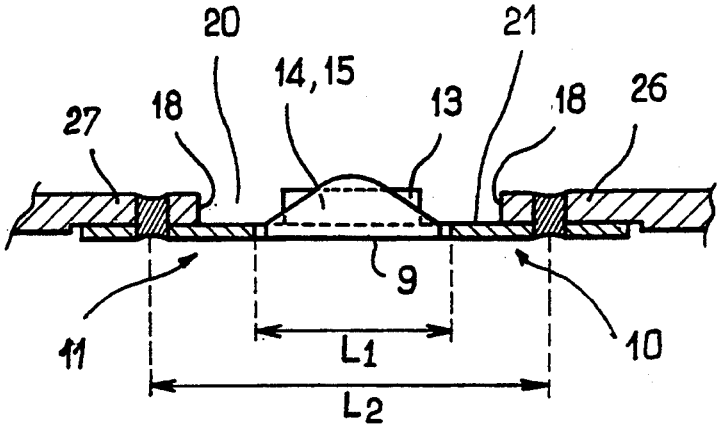
FIG. 4 is an enlarged sectional view along line IV—IV of FIG. 2.

Referring to FIG. 2, according to a preferred form of this invention, the fuse link part 8 is, for a same gauge, of constant thickness and is constituted by at least one central gauging zone in zinc alloy (approximately 99.7% zinc) disposed between two lateral zones 10 and 11 to be connected to the connection terminal blades 5 and 6 respectively. The central gauging zone 9 has a width $l_1$ less than the width $l_2$ of the adjacent zones 10, 11 so as to provide shoulders 12, while the length $L_1$ of the gauging zone is less than or equal to two-thirds the length $L_2$ of the fuse link part (FIG. 4).

A drop of metal 13, preferably a tin-silver or tin-lead alloy, is deposited on the gauging zone 9. The drop 13 is in contact on the gauging zone 9 over an area of contact $S_1$ which is at least greater than half the area $S_2$ of the side of the gauging zone receiving said drop. Preferably, the area of contact $S_1$ is substantially equal to that $S_2$ of the gauging zone.

A means for limiting the expansion of the drop 13, when the latter lets, is provided on the gauging zone 9. The limiting means is constituted by at least one blade of low height, and preferably, by two blades 14 and 15 which are each connected to a longitudinal side 16, 17 of the gauging zone 9, and in a plane perpendicular to the plane containing said gauging zone (FIG. 4).

Figure 3:
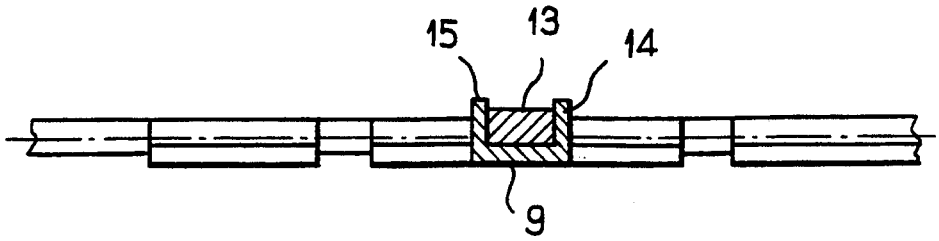
FIG. 3 is an enlarged sectional view along line III—III of FIG. 2.

According to one embodiment (FIG. 3), each blade 14, 15 has a rounded profile and is provided substantially equidistant from the inner edges of the connection zones (18) provided on the connection terminal blades 5 and 6. The fuse link part 8 is electrically welded or seam welded to the underside of the connection terminal blades 5, 6 as seen in the two-dimensional view in FIG. 2, and, preferably though not necessarily, has a low thickness for a housing for the drop 13 to be arranged between the gauging zone 9 and the inner edges 18 of the connection terminal blades 5, 6.

The portion 21 of each connection zone 10, 11 included between the shoulder 12 and the corresponding welding zone 22 also constitutes an additional area of heat dissipation which will be discussed hereinafter.

By drop of metal is meant a very small mass of metal which can be of any shape, whether regular or not, such as a sphere or parallelepiped. The drop of metal is made interdependent with the gauging zone by melting or any other suitable means.

Figure 5:
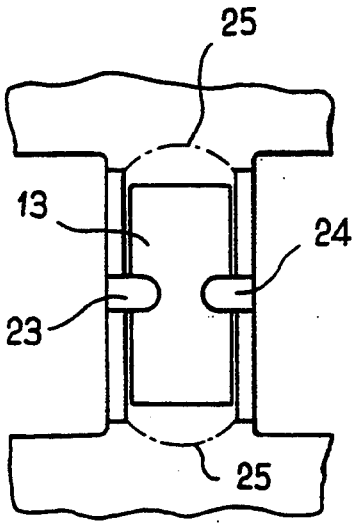
FIG. 5 is a partial top view of the gauging zone represented in FIG. 2, with blades folded back over the drop of metal.

Preferably, each blade 14, 15 whose height is substantially equal to or greater than the corresponding dimension of the drop, has a free upper part 23, 24 which can be folded over the drop 13 so as to better confine said drop whose expansion is limited both in the upward direction by the parts 23, 24, after folding, and laterally by the blades. Consequently, when the drop is passed through by a high electrical current which produces a melting of said drop 13, it is compelled to take the shape of the blades 14, 15 and can only spread towards the shoulders 12. In fact, experiments have shown that the drop 13 takes on the shape represented in FIG. 5, i.e. it has a sort of meniscus 25 at its ends.

Figure 6:
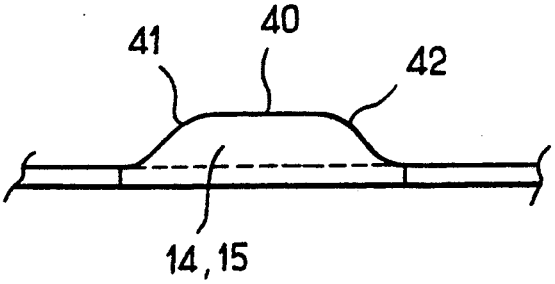
FIG. 6 is a front view of the trapezoid-shaped expansion limiting blades.

According to another shape of embodiment of the blades represented in FIG. 6, the blades 14 and 15 are in the shape of a trapezoid whose free upper edge 40 is substantially rectilinear with rounded lateral ends 41 and 42.

On both sides of each median part 26, 27 of the connection terminal blades 5, 6 to which is connected a lateral zone 10, 11 of the fuse link part 8, are provided heat dissipation fins 28, 29 which are separated from the median part 26, 27 by two notches 30, 31 having as role to delimit the fins 28, 29 for the cooling of the connection terminal blades 5, 6 and of the four attachment points of said connection terminal blades to the case 1, represented in FIG. 1.

The connection terminal blades 5, 6 each comprise two openings 32, 33 to mount them by crimping on slugs provided for this purpose in the supporting body 3 of the protective case 1.

Each connection terminal blade 5, 6 comprises, on the outer side 5b, 6c, opposite the inner side 5a, 6a, a cut-out or notch 34, 35, intended to enable, during continuous production in the form of a band, the conductive unit 4 to be housed in the case 1.

In operation, the passing of an electrical current in the fuse link part 8, via the connection terminal blades 5, 6, creates a hot spot which is situated substantially in the center of the gauging zone 9.

At a nominal intensity of $I_N$, inscribed e.g. on the case 1, the alloy of the drop 13 is in a solid state and the temperature in the gauging zone is below the eutectoid point of the alloy.

For low current overcharges ($1.35 \times I_N$ for 30 minutes), the drop 13 changes to the liquid state while remaining centered on the hot spot, but the alloy constituting it diffuses in the material of the gauging zone 9 in zinc. The melting point of the gauging zone 9 is situated between that of the alloy of the drop and that of the zinc. In this; way, the temperature communicated to the connection terminal blades 5, 6 during the very slow melting is reduced, with the reduced length of the gauging zone eliminating all risk of contact with the case 1 for said low overcharge.

For average overcharges (from 2 to $3.5 \times I_N$), the melting time of the drop 13 is relatively short, of the order of a few seconds, and the melted alloy of said drop does not have the time to diffuse in the zinc of the gauging zone. The melting point is close to that of the zinc as the break occurs essentially on the zinc thickness. Thus, there is quick breaking on one of the sides of the drop and the gauging zone is maintained in the same state with a slight sagging that does not make contact with the case.

For high overcharges (of up to 800 amperes), the alloy of the drop remains in the solid state and the gauging zone 9 splits randomly on one or other side of said drop, without sagging outside the plane of the fuse link part.

The heat dissipation fins 28 and 29 of the connection terminal blades 5 and 6 receive an impression 22a when the welding electrode wheel passes between the fuse link part 8 and said connection terminal blades and, more precisely, between the parts 10, 11 of the fuse link part and said connection terminal blades.

Figure 7:
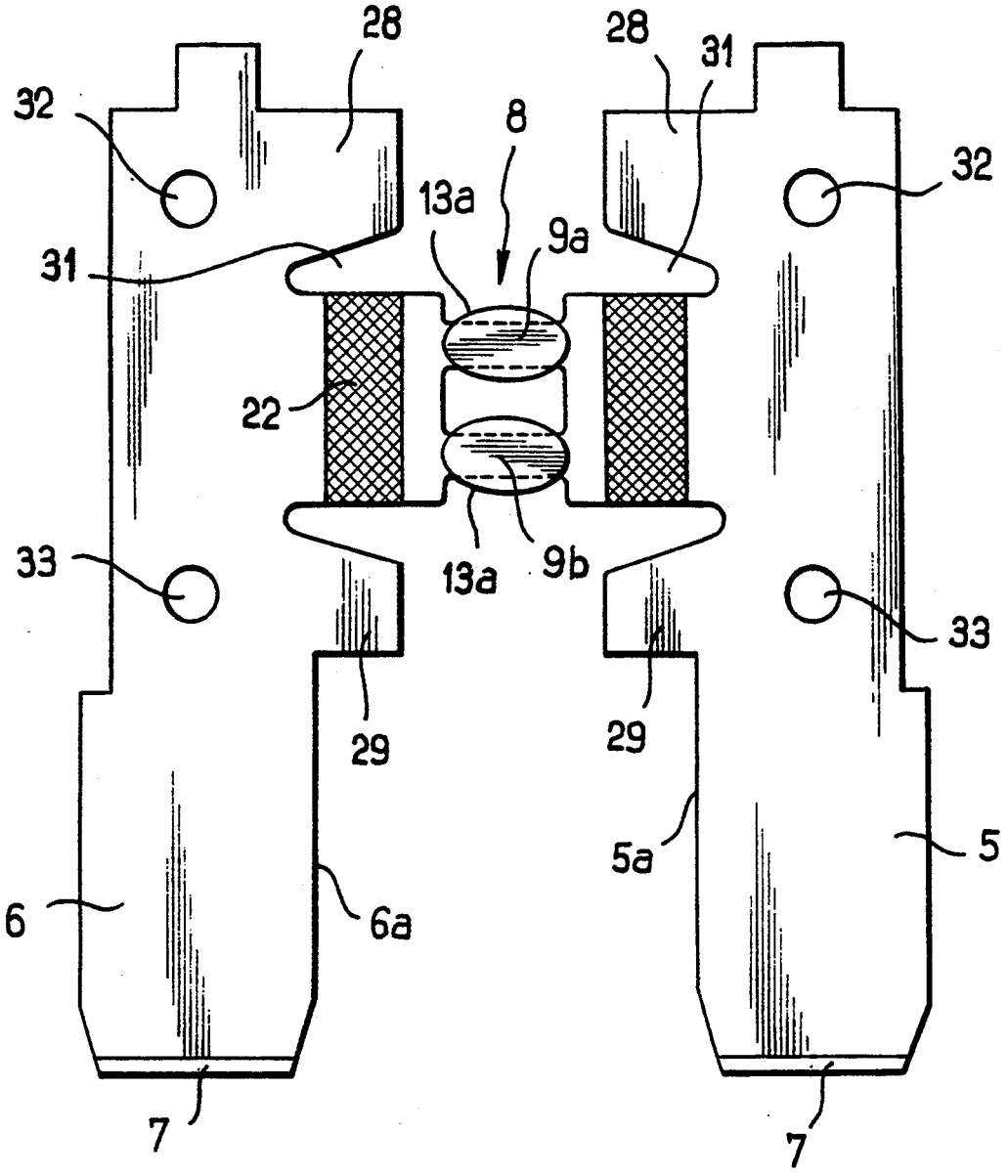
FIG. 7 is a two-dimensional view of the conductive unit according to a second embodiment of the invention.

Another embodiment of the conductive unit is represented in FIG. 7. In this embodiment, the fuse link part comprises two gauging zones 9a and 9b which are mounted parallel to one another but are situated in a same horizontal plane, slightly below the plane containing the connection terminal blades 5, 6; each gauging zone 9a, 9b has the dimensional features of the gauging zone 9 as defined hereinabove. A drop of metal 13a is deposited on at least one of the gauging zones 9a or 9b and, if necessary, on each gauging zone, as represented in FIG. 7. Likewise, one or both the gauging zones 9a, 9b are provided with expansion limiting blades represented in one of FIGS. 2 to 7. The drop(s) 13a are in tin-silver alloy. The gauging zones 9a, 9b are not tinned on both sides and are approximately 0.3 mm thick. As the gauging zones 9a, 9b are in zinc alloy (approximately 99.7% zinc), such a thickness is best suited to the forming of the tin-silver/zinc alloy.

The drops of metal 13a come either from a welding wire with incorporated soldering flux, or from a predimensioned element, in the shape of a slug, as represented in FIGS. 2 to 6. Furthermore, one or more the gauging zones 9a, 9b can comprise the expansion limiting means 14, 15 described in reference to FIGS. 2 to 6.

The passing of an electrical current in the connection terminal blades 5, 6 and then in the fuse link part 8 creates a hot spot at the center of each gauging zone 9a and 9b. At a nominal intensity of $I_N$ of the flat fuse, e.g. 50 amperes, the drops of metal 13Aa are in a solid state as the temperature of the hot spots is below 221° C. approximately.

For low current overcharges, up to $1.35 \times I_N$ for a maximum of 30 minutes, the drops of metal 13a change to a liquid state, the temperature of the hot spots being then in excess of 220° C., and below the melting point of the gauging zone 9a without a drop. Accordingly, the temperature communicated to the connection terminal blades 5 and 6 is reduced and the behaviour under heat of the case 3 is achieved and the risk of contact of the gauging zones 9a, 9b with the walls of the case is averted. When the gauging zones become deformed due to a rise in temperature, the breakage of one of these causes the instantaneous breaking of the other, and the sectioning of the gauging zones can occur indifferently to the right or the left of the weld drop.

For average overcharges, of the order of $2 \times I_N$, the drops of metal 13a retard the temperature increase of the hot spots and spread randomly on one or the other side, or on both sides, of the hot spots. As the break time is short, approximately 10 seconds, the tin-silver/zintane alloy does not have time to form. The gauging zones 9a and 9b then break in the region of the hot spots, i.e. substantially at their center.

For high overcharges, well in excess of $4 \times I_N$, the drops of metal 13a do not have the time to melt. A random sectioning of the gauging zones then ensues, generally where the cross-section is smallest.

Finally, the various components of the fuse according to the two embodiments described hereinabove easily lend themselves to series production in the form of interconnected beads so as to be capable of being wound in the form of coils. For this purpose, the elements of the case are provided with lateral attachments, which are not represented, connecting the supports to one another and the covers to one another. Likewise, the electrical elements, i.e. the connection terminal blades and the gauging part, are also produced in the form of interconnected beads. The installation of the various component parts of the fuse can then be performed according to suitable sequences, after which, the finished fuses are separated by a sectioning of the lateral attachments.

We claim:

1. A fuse for high nominal currents, comprising:

a case;

two flat connection terminal blades partially housed within the case;

a flat fuse link part connecting the two terminal blades, the fuse link part comprising:

(i) a central gauging zone of predetermined length and width defining a predetermined surface area; and (ii) two lateral portions connected by the central gauging zone, the lateral portions each having a width greater than the width of the central gauging zone, each of the lateral portions being connected to one of the terminal blades by connecting means, the connecting means being separated from each other by a distance, the predetermined length of the central gauging zone being at most equal to two-thirds of the distance separating the connecting means; and at least one drop of metal deposited substantially in the center of the central gauging zone, the drop of metal having a predetermined area of contact with the central gauging zone, the predetermined area of contact of the drop of metal being substantially equal to the predetermined surface area of the central gauging zone.

2. A fuse as claimed in claim 1, further comprising means for limiting expansion of the drop of metal, the limiting means comprising a member extending in a direction perpendicular to the predetermined surface area of the central gauging zone.

3. A fuse as claimed in claim 2, wherein the limiting means comprises at least one blade.

4. A fuse as claimed in claim 2, wherein the limiting means comprises two blades disposed on opposite sides of the drop of metal.

5. A fuse as claimed in claim 3, wherein the blade includes a free upper part which can be folded over the drop of metal.

6. A fuse as claimed in claim 5, wherein the blade is trapezoid-shaped.

7. A fuse as claimed in claim 1, wherein the connection terminal blades overlie a part of the respective lateral portions of the fuse link part, so as to provide a well for the drop of metal between the connection terminal blades.

8. A fuse as claimed in claim 1, wherein the lateral portions partially constitute heat dissipation zones.

9. A fuse as claimed in claim 1, wherein at least one of the connection terminal blades includes a heat dissipation fin.

10. A fuse as claimed in claim 1, wherein each connection terminal blade includes a pair of heat dissipation fins disposed on opposite sides of the fuse link part.

11. A fuse as claimed in claim 10, wherein the heat dissipation fins are separated from the fuse link part by notches.

12. A fuse as claimed in claim 11, wherein each connection terminal blade includes a recess at an outer side opposite the fuse link part.

13. A fuse as claimed in claim 11, wherein the drop of metal comprises a tin-silver alloy.

14. A fuse as claimed in claim 11, wherein the drop of metal comprises a tin-lead alloy having a melting point of between 180° C. and 420° C.

15. A fuse as claimed in claim 9, wherein the heat dissipation fins of the connecting terminal blades include an impression created by a welding electrode wheel.

16. A fuse as claimed in claim 1, wherein the fuse link part comprises two central gauging zones, a drop of metal being disposed substantially in the center of at least one of the two central gauging zones.

17. A fuse as claimed in claim 16, wherein a drop of metal is disposed on each gauging zone.

18. A fuse as claimed in claim 17, further comprising means for limiting expansion of the drop of metal provided on at least one of the two gauging zones.

* * * * *